US007713359B2

(12) United States Patent
Jinbäck

(10) Patent No.: US 7,713,359 B2
(45) Date of Patent: May 11, 2010

(54) DEVICE FOR INTERIOR FLUSHING OF TANKS OR CONTAINERS

(75) Inventor: Lars Jinbäck, Shooters Hill (GB)

(73) Assignee: Scanjet Marine AB, Sjobo (SE)

( * ) Notice: Subject to any disclaimer, the term of this patent is extended or adjusted under 35 U.S.C. 154(b) by 1151 days.

(21) Appl. No.: 10/557,063

(22) PCT Filed: May 18, 2004

(86) PCT No.: PCT/SE2004/000763

§ 371 (c)(1),
(2), (4) Date: Nov. 15, 2005

(87) PCT Pub. No.: WO2004/103586

PCT Pub. Date: Dec. 2, 2004

(65) Prior Publication Data

US 2006/0243307 A1 Nov. 2, 2006

(30) Foreign Application Priority Data

May 22, 2003 (SE) ..... 0301490

(51) Int. Cl.
*B08B 3/02* (2006.01)

(52) U.S. Cl. ..... 134/167 R; 134/168 R

(58) Field of Classification Search ..... 134/167 R, 134/168 R

See application file for complete search history.

(56) References Cited

U.S. PATENT DOCUMENTS 3,401,060 A * 9/1968 Watts ..... 134/1
3,472,451 A * 10/1969 Lione et al. ..... 239/227
3,595,256 A * 7/1971 Waltman et al. ..... 134/167 R
3,696,825 A * 10/1972 Guignon et al. ..... 134/167 R
3,874,594 A * 4/1975 Hatley ..... 239/227
3,895,756 A * 7/1975 Jaeger ..... 239/227
4,082,057 A * 4/1978 Hayes ..... 118/702
4,716,917 A * 1/1988 Schmidt ..... 134/167 R
5,279,675 A * 1/1994 Verbeek ..... 134/22.1
5,351,885 A * 10/1994 Manabe ..... 239/73

(Continued)

FOREIGN PATENT DOCUMENTS

DE 4 16 649 * 11/1994

(Continued)

*Primary Examiner*—Frankie L Stinson
(74) *Attorney, Agent, or Firm*—Tarolli, Sundheim, Covell & Tummino LLP

(57) ABSTRACT

The present invention relates to a device for interior flushing of spaces in tanks or containers. At least one rotatable part (8) of a pipe (6, 8, 11) for the supply of flushing liquid (7) is provided in the space (2) and said rotatable part (8) has at least one flushing nozzle (9) for discharging jets (10) of flushing liquid. A driving or operating device (22) is provided to rotate said rotatable part (8) about a geometric rotation axis (R1A) and the flushing nozzle (9) about another geometric rotation axis (R2A). The driving device (22) is provided to be brought to rotate in opposite rotary directions (R1, R2) by reversing its rotary direction. A switch device (23) is provided to bring either said rotatable part (8) or the flushing nozzle (9) to rotate in dependence of the rotary direction (R1 or R2) of the driving device (22). A control device (48) is provided to control the driving device (22) to rotate in one or the opposite rotary direction (R1 or R2).

24 Claims, 5 Drawing Sheets

U.S. PATENT DOCUMENTS 5,482,063 A * 1/1996 Miura et al. ..... 134/56 R
5,673,717 A * 10/1997 Jinback ..... 134/167 R
5,715,852 A * 2/1998 Jepsen ..... 134/167 R
5,718,382 A * 2/1998 Jaeger ..... 239/227
5,896,871 A * 4/1999 Larsen ..... 134/22.1
6,039,056 A * 3/2000 Verbeek ..... 134/22.18
6,460,553 B1 * 10/2002 Owens et al. ..... 134/167 R
6,554,212 B2 * 4/2003 Borcea et al. ..... 239/391
2004/0089329 A1 5/2004 Bijster

FOREIGN PATENT DOCUMENTS

EP 0 619 148 B1 11/1996
EP 0 892 685 B1 3/2001
GB 2 096 455 * 10/1982
JP 08-290140 * 11/1996
WO WO 02/47825 * 6/2002

* cited by examiner

DEVICE FOR INTERIOR FLUSHING OF TANKS OR CONTAINERS

FIELD OF THE INVENTION

The present invention relates to a device for interior flushing of spaces in tanks or containers, wherein at least one pipe is provided for the supply of flushing liquid to the space, wherein a rotatable part of the pipe has at least one flushing nozzle for discharging jets of flushing liquid and wherein a driving or operating device is provided to rotate said rotatable part of the pipe about a geometric rotation axis and the flushing nozzle about another geometric rotation axis.

BACKGROUND OF THE INVENTION

Devices for interior flushing of ship's tanks or similar are previously known from the publication EP 0 892 685. At the device according to this publication, one motor is used to rotate the rotatable part of a pipe for the supply of flushing liquid and another motor for rotating the flushing nozzle. Using two motors however, for rotating the rotatable part and the flushing nozzle, is an expensive and energy consuming solution which is sensitive to shutdowns.

SUMMARY OF THE INVENTION

The object of the present invention has therefore been to provide a substantial simplification and improvement of prior art. This is arrived at by providing the device defined above with the characterizing features of subsequent claim 1.

By providing a reversible driving device through a double switch device operating either the flushing-liquid pipe or the flushing nozzle, a cheap, energy saving and reliable arrangement is obtained for operating the flushing device.

BRIEF DESCRIPTION OF THE DRAWINGS

The invention will be further described below with reference to the accompanying drawings, in which.

DESCRIPTION OF EXAMPLE EMBODIMENTS

Figure 1:
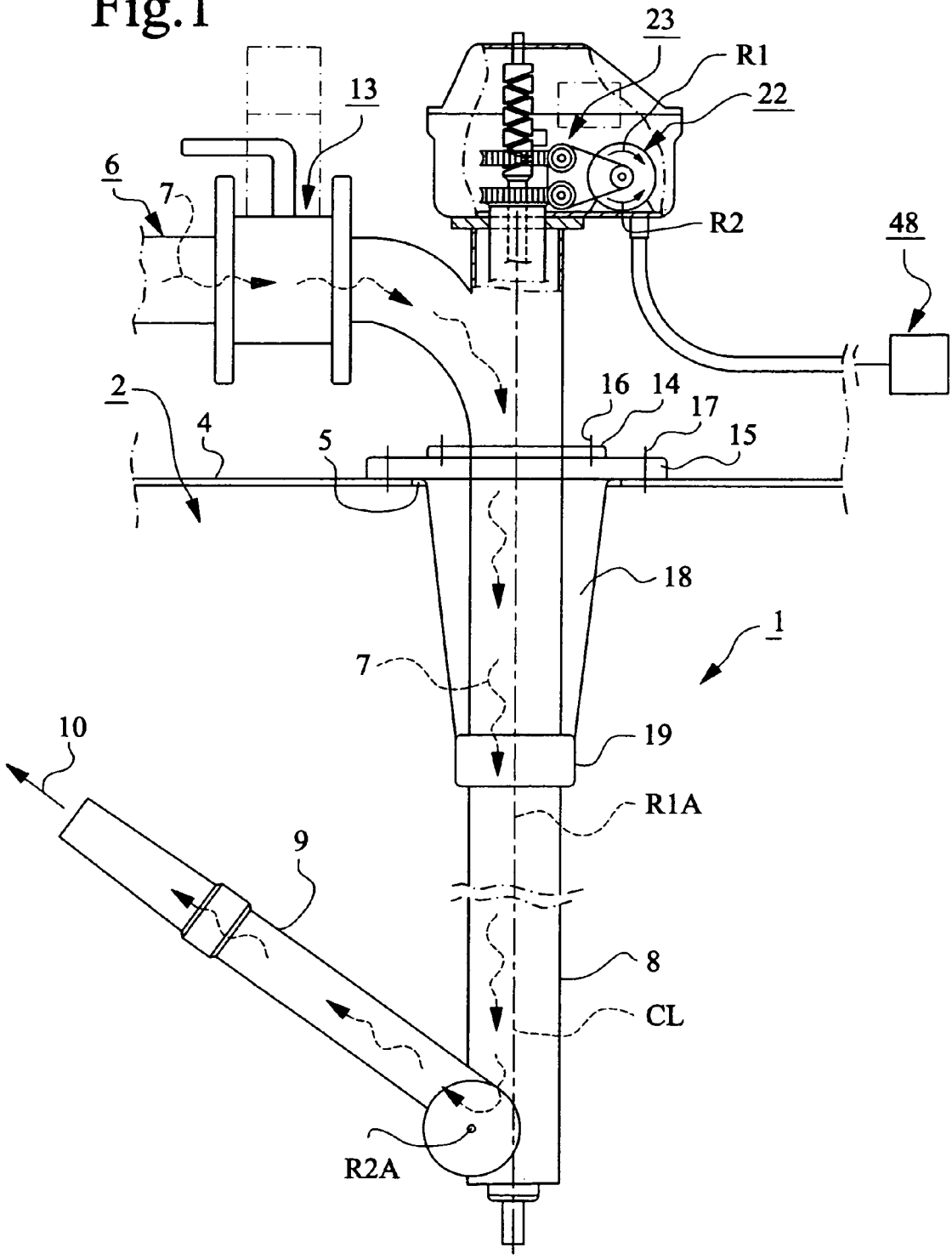
FIG. 1 is a side view of a device according to the invention.
Figure 2:
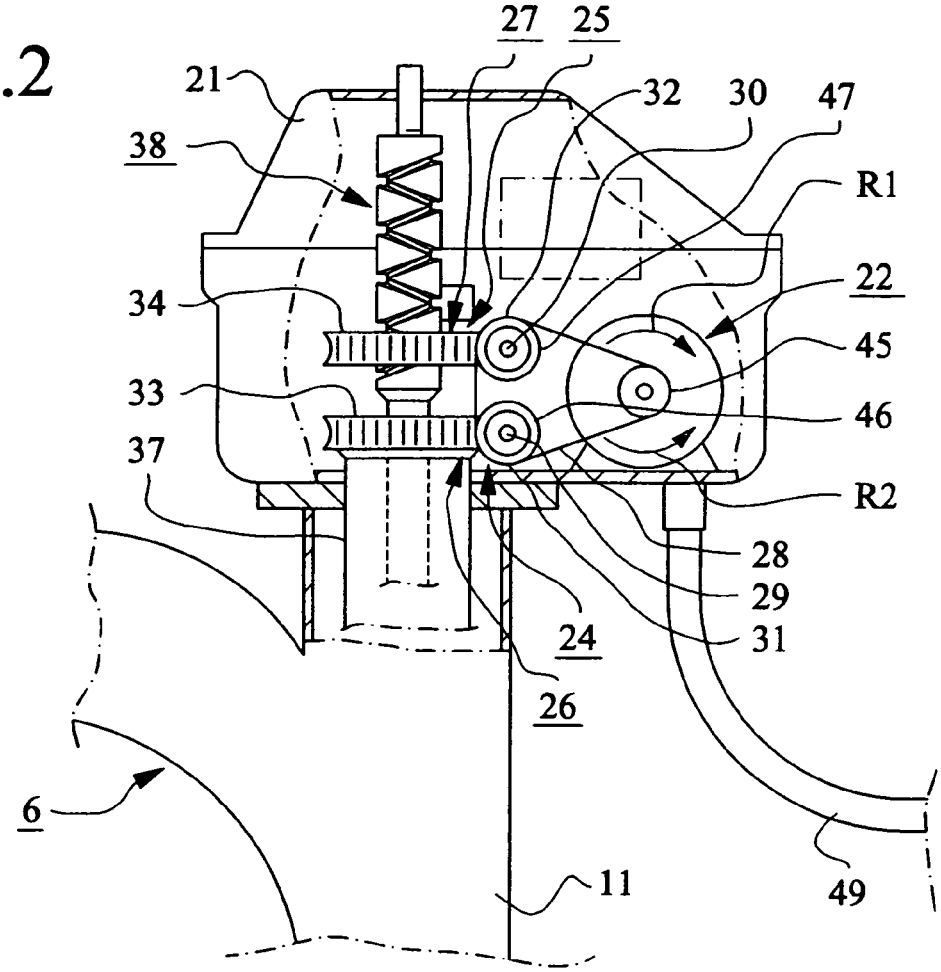
FIG. 2 is an enlarged view of a part of the device of FIG. 1.
Figure 3:
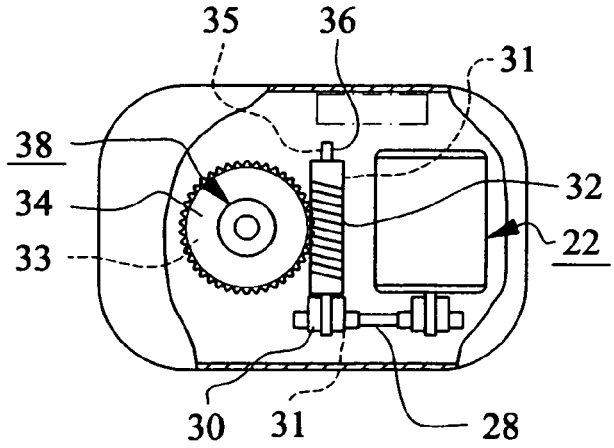
FIG. 3 is a plan view of a part of the device of FIG. 1.
Figure 4:
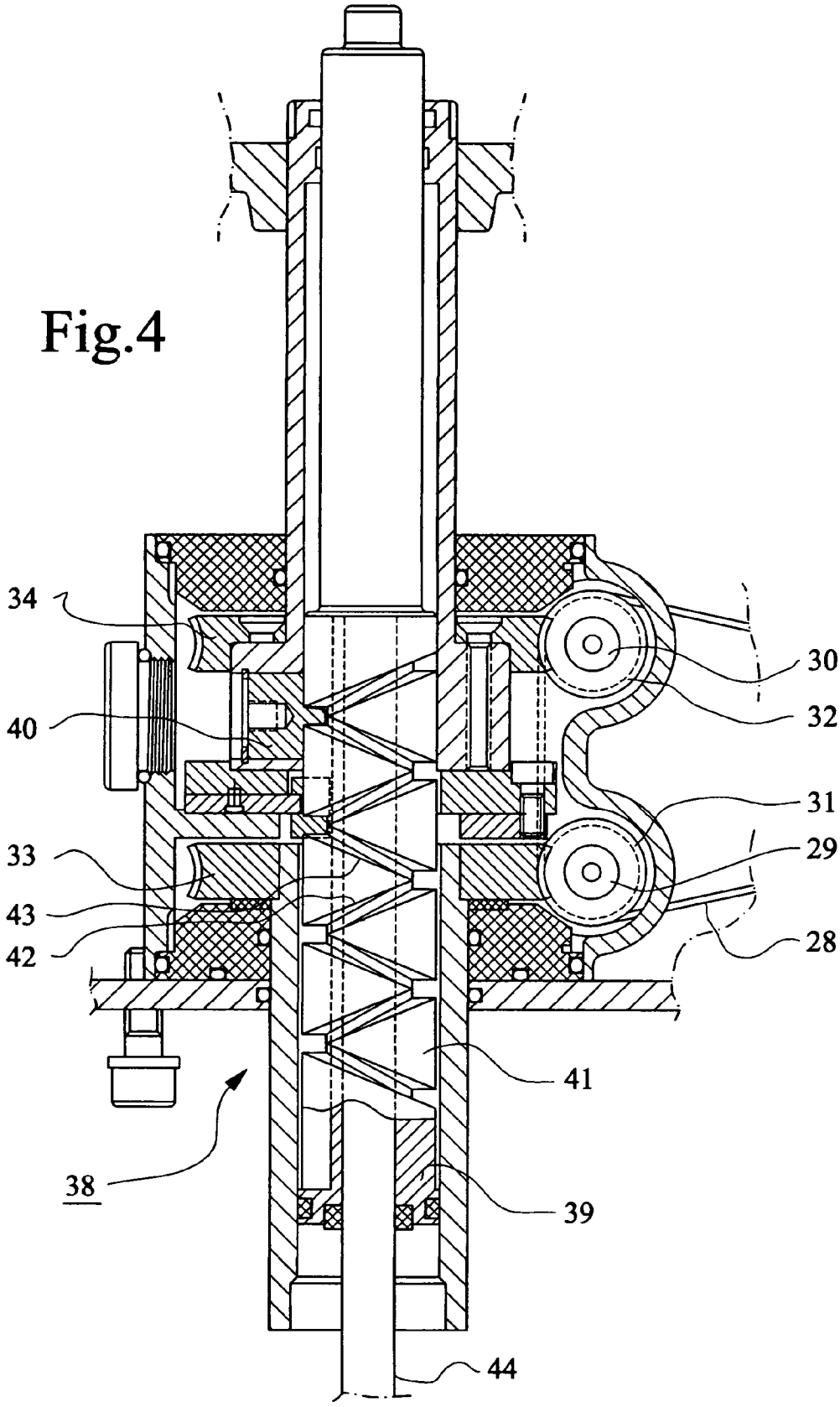
FIG. 4 is a section through a part of the device of FIG. 1.

The device 1 illustrated in the drawings is adapted for flushing spaces 2 in containers 3, the upper side 4 of which has an opening 5. The container 3 may be a ship's tank, whereby the upper side 4 may be the deck of the ship, but the container 3 can also be of another type and it can be transportable or stationary.

The flushing device 1 comprises at the embodiment according to the figures a supply conduit 6 for feeding flushing liquid 7 to a flushing-liquid pipe 8 and at least one flushing nozzle 9 mounted thereon and provided to discharge jets 10 of flushing liquid for interior flushing of the space 2.

The supply conduit 6 has a vertically directed member 11 and a horizontally directed member 12 connected thereto. The flushing liquid 7 is brought to flow through the horizontally directed member 12 by means of a pump device (not shown) or similar to the vertically directed member 11 and through that member into the flushing-liquid pipe 8. The horizontal member 12 may include a control valve 13 for regulating the inflow of flushing liquid 7 to the flushing-liquid pipe 8. Lower parts of the vertically directed member 11 of the supply conduit 6 has a flange 14 which is attached to a larger flange 15 by means of bolts 16. The larger flange 15 is in turn attached to said upper side 4 by means of bolts 17.

At the top, the flushing-liquid pipe 8 is rotatably mounted in the vertically directed member 11 of the supply conduit 6 and extends through the opening 5 down into the space 2. The flange 15 may have a downwardly directed bearing cage 18 with a bearing 19 which is located in the space 2 and in which the flushing-liquid pipe 8 is rotatably mounted.

On an upper part of the vertically directed member 11 of the supply conduit 6 there is provided a housing 21 for a driving or operating device 22 and a switch device 23. The driving device 22 is provided to rotate, through the switch device 23, the flushing-liquid pipe 8 about a geometric rotation axis R1A which in the present embodiment is vertically or substantially vertically directed, and to impart to the flushing nozzle 9 a movement about another geometric rotation axis R2A which in the present embodiment is horizontal or substantially horizontal.

The driving device 22 is provided to rotate in opposite rotary directions R1 or R2 by switching the rotary direction thereof. The switch device 23 is provided to transmit, when the driving device 22 is driven or operated to rotate in the rotary direction R1 (e.g. clockwise), the rotary movement of the driving device 22 to the flushing-liquid pipe 8 for rotation thereof, but not to the flushing nozzle 9. The switch device 23 is further provided to transmit, when the rotary movement of the driving device 22 is reversed such that it is driven in the opposite rotary direction R2 (e.g. counter clockwise), said opposite rotary movement of the driving device 22 to the flushing nozzle 9 for rotation thereof, but not to the flushing-liquid pipe 8.

The driving device 22 is operated preferably not by the flow of flushing liquid in the supply conduit 6 but by other energy. Thus, the driving device 22 may be an electrically, pneumatically or hydraulically driven or operated motor, whereby an electrically operated motor is the most suitable. The driving device 22 may be a servo-motor and it may operate with a rotation speed of 500-1000 rpm and bring the flushing-liquid pipe 8 to rotate, through the switch device 23, with 0.5-1 rpm.

The switch device 23 has, in the embodiment shown, two driving gears 24, 25 and each gear includes a pair of transmission elements 26, 27. A movement transfer means 28 is provided to transmit the rotary movements of the driving device 22 to the transmission element pairs 26, 27 of the two driving gears 24, 25 through two movement transfer and clearance devices 29, 30. A transmission element pair 26, 27 in each driving gear 24, 25 is associated with each movement transfer and clearance device 29, 30 and one of said devices 29 is provided to transmit the movement of the movement transfer means 28 to the transmission element pair 26 of one of the driving gears 24, while the other movement transfer and clearance device 30 is provided to simultaneously permit clearance such that the movement of the movement transfer means 28 is not at the same time transmitted to the transmission element pair 27 of the other driving gear 25. The other movement transfer and clearance device 30 is provided to transmit the movement of the movement transfer means 28 to the transmission element pair 27 of said other driving gear 25, while said one or first movement transfer and clearance device 29 is provided to simultaneously permit clearance such that the movement of the movement transfer means 28 is not at the same time transmitted to the transmission element pair 26 of said one driving gear 24.

Each driving gear 24 and 25 respectively, is preferably a worm gear having a transmission element preferably in the form of a worm 31 and 32 respectively, which both are driven by the driving device 22 through the movement transfer means 28, and a transmission element, preferably in the form of a gear wheel 33 and 34 respectively, cooperating with each worm 31 and 32 respectively. Each worm 31 and 32 respectively, is non-rotatably mounted on a drive shaft 35 and 36 respectively, which each includes a movement transfer and clearance device 29 and 30 respectively, such that the movement transfer means 28 cooperates with each worm gear through a movement transfer and clearance device 29 and 30 respectively. The gear wheel 33 of the driving gear 24, i.e. of the pair of transmission elements 26, brings the flushing-liquid pipe 8 to rotate by being connected thereto through a connecting member 37, preferably in the form of a pipe, which extends through the vertically directed member 11 of the supply conduit 6 and which down below is attached to upper parts of the flushing-liquid pipe 8 for rotation of said pipe 8 about a geometric centre line CL relative to which the gear wheel 33, the connecting member 37 and the flushing-liquid pipe 8 preferably are centered.

The driving gears 24, 25 in the form of worm gears may be of an irreversible type, meaning that they can rotate in one direction only.

The gear wheel 34 of the driving gear 25, i.e. of the transmission element pair 27, cooperates with a device 38 for transferring the rotary movements of the gear wheel 34 into reciprocating motions. This device 38 drives or operates in turn an elongated member 39, preferably in the form of a rod, which is brought to move with reciprocating motions and which through a turning device (not shown) imparts oscillating movements to the flushing nozzle 9.

The device 38 for transferring the rotary movements of the gear wheel 34 into reciprocating motions, may be constructed in different ways. At the embodiment of FIG. 1, this device 38 includes a carrier 40 which is centered with the centre line CL and which is driven by the gear wheel 34 to rotate about said centre line and about a threaded rod 41 or similar. Said rod 41 is also centered with the centre line CL and it is journalled to move in reciprocating motions relative to said centre line CL but not to rotate thereabout. The rod 41 has two threads 42, 43 with different thread directions and these threads 42, 43 transform into each other at thread transitions at the end portions of the threads 42, 43 and transform into each other such that the carrier 40 during continuous rotation in one direction can engage or mesh with one of the threads 42 and 43 and through said thread transitions pass over into engagement with the other thread 43 or 42 for imparting reciprocating motions continuously to the threaded rod 41 and thereby, movements to the flushing nozzle 9.

The threaded rod 41 may cooperate with the flushing nozzle 9 through a coupling rod 44 or similar which extends in a direction downwards through the tubular connecting member 37 and the flushing nozzle 8 and which preferably is centered with the centre line CL.

The movement transfer means 28 can be an endless means, e.g. an endless belt or chain. This endless means runs over a rotating disk 45 on an output shaft of the driving device 22 and over two disks 46, 47 which through the movement transfer and clearance devices 29, 30 are located on the driving shafts 35, 36 of the worms 31, 32. A gear wheel is an alternative to an endless means.

A control device 48 cooperates with the driving device 22 through a line 49 and is adapted to control the driving device 22 to rotate in either of the rotary directions, i.e. in one or the opposite rotary direction R1 or R2. This means that the control device 48 controls the driving device 22 to rotate either the flushing-liquid pipe 8 or the flushing nozzle 9. The control device 48 can be brought to control the driving device 22 in accordance with certain control programs which are chosen in view of the look of the space 2. Such a control program can e.g. control the driving device 22 to rotate the flushing-liquid pipe 8 in one or several revolutions with the flushing nozzle 9 set for flushing a certain level of the space 2. When this flushing is finished, the control program can control the driving device 22 to instead rotate the flushing-liquid pipe 8 to set it for flushing an adjacent level of the space 2, and then, the control program controls the driving device 22 to once again rotate the flushing-liquid pipe 8 for flushing said latter level and so on.

Figure 5:
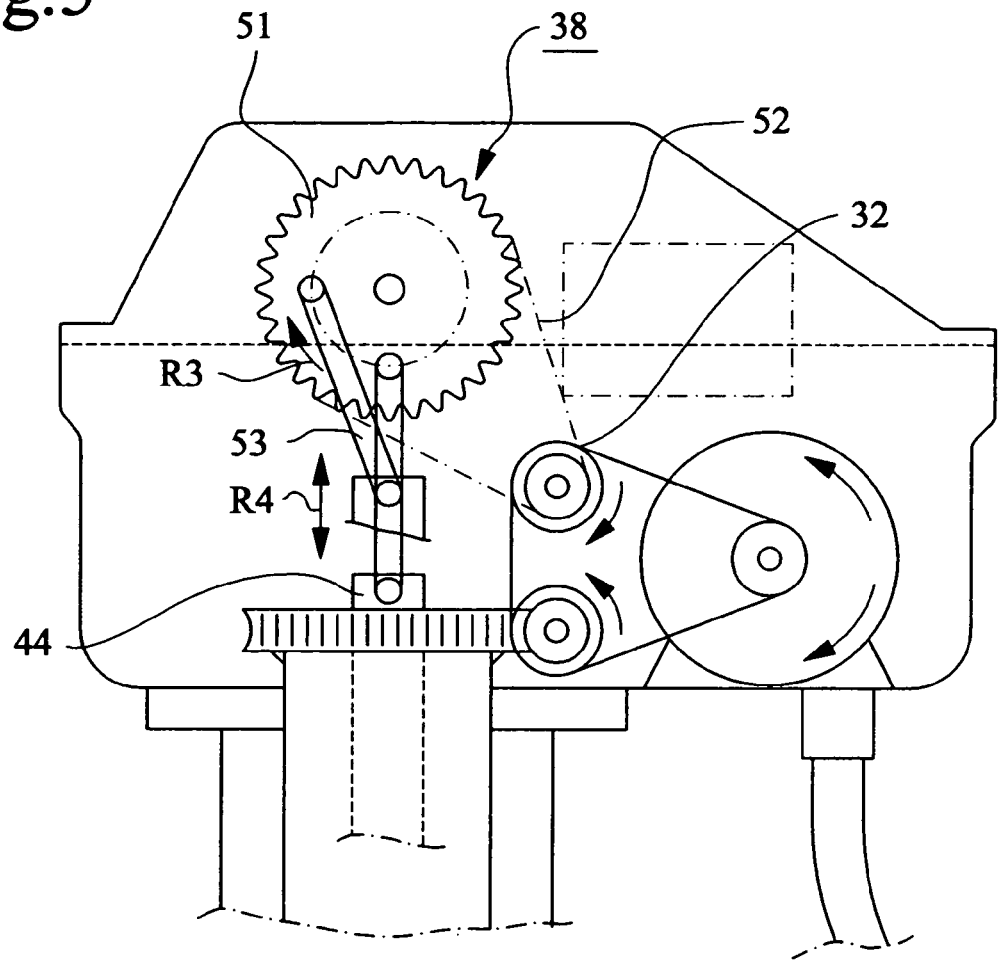
FIG. 5 illustrates a first alternative embodiment of a part of the device of FIG. 1.

FIG. 5 schematically illustrates a first alternative to the device described above for transferring a rotary movement into a reciprocating motion. At this first alternative, a pulley 51 (here replacing the gear wheel 34), a belt 52 and a connecting rod 53 is used. The belt 52 is provided to transmit the rotary movement of the worm 32 to the pulley 51 such that said pulley rotates in the rotary direction R3. The connecting rod 53 cooperates, with an upper end, with the pulley 51 and, with a lower end, with the coupling rod 44, such that when the pulley 51 rotates in the rotary direction R3, up- and downward motions are imparted to the connecting rod 53, which are transmitted to the coupling rod 44. Thus, a rotary movement is here transferred into a reciprocating motion R4 through a connecting rod movement.

Figure 6:
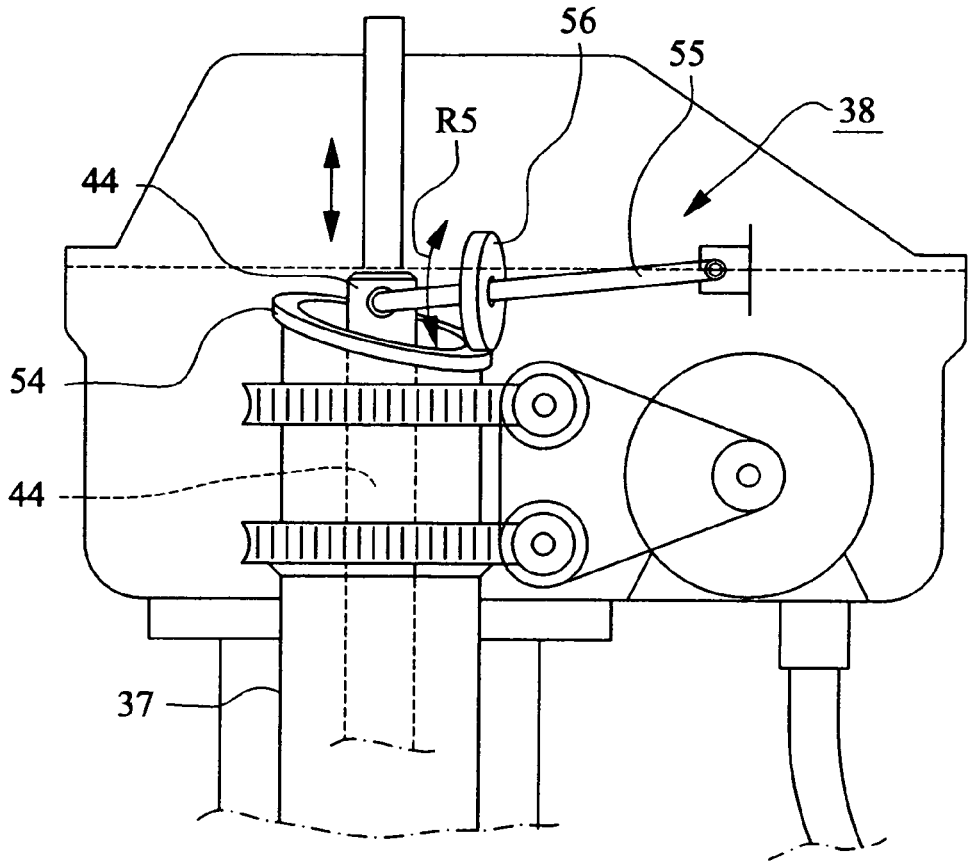
FIG. 6 illustrates a second alternative embodiment of a part of the device of FIG. 1.

FIG. 6 schematically illustrates a second alternative to the device described above for transferring a rotary movement into a reciprocating motion. At this second alternative, a cam disk 54, an arm 55 and a roller 56 which is rotatably mounted on said arm, is used. The cam disk 54 is brought to rotate along with the tubular connecting member 37. The cam of the cam disk 54 is inclined relative to the longitudinal direction of the coupling rod 44, one end of the arm 55 cooperates with the machine and its other end with the coupling rod 44. Since the roller 56 runs on the inclined cam of the cam disk 54, it will impart to the arm 55, and thereby to the coupling rod 44, up- and downwardly reciprocating motions R5. Thus, a rotary movement is here through a cam movement transferred into a reciprocating motion R5.

The invention is not limited to the embodiment described above and illustrated in the drawings, but may with regard to its construction and function vary within the scope of the subsequent claims. Thus, the driving or operating device 22, the switch device 23 and the transfer device 38 may e.g. be constructed otherwise than described. The control valve 13 may cooperate with a control device 50 which preferably is remote-controlled and which can control the control valve 13 to let pass larger or smaller amounts or volumes of flushing liquid per time unit. The control device 50 may e.g. temporarily interrupt the flow of flushing liquid through the supply conduit 6 if e.g. the flushing nozzle 9 has flushed a part of the space 2 and one wishes to redirect the nozzle towards another part of the space 2 without flushing during this redirection.

The invention claimed is:

1. Device for interior flushing of spaces in tanks or containers, comprising:

at least one pipe (6, 8, 11) for the supply of flushing liquid (7) to the space (2), a rotatable part (8) of said pipe (6, 8, 11) has at least one flushing nozzle (9) for discharging jets (10) of flushing liquid;

a driving or operating device (22) to rotate said rotatable part (8) about a geometric rotation axis (R1A) and the flushing nozzle (9) about another geometric rotation axis (R2A), the driving device (22) is provided to be brought to rotate in opposite rotary directions (R1, R2) by reversing the rotary direction of the driving device (22);

a switch device (23) is provided to bring either said rotatable part (8) or the flushing nozzle (9) to rotate in dependence of the rotary direction (R1 or R2) of the driving device (22);

a control device (48) is provided to control the driving device (22) to rotate in one or the opposite rotary direction (R1 or R2), wherein the switch device (23) comprises two driving gears (24, 25) which each includes a transmission element pair (26, 27), a movement transfer means (28) is provided to transmit the rotary movements of the driving device (22) to the transmission element pairs (26, 27) of the two driving gears (24, 25) through two one-way movement transfer devices (29, 30) of which each is associated with the transmission element pair (26, 27) in each driving gear (24, 25), and one of said one-way movement transfer devices (29 or 30) is provided to transmit the movement of the movement transfer means (28) to the transmission element pair (26 or 27) of one of the driving gears (24 or 25) when the movement transfer means (28) is driven in one direction by the driving device (22), while the other one of said one-way movement transfer devices (30 or 29) is provided to simultaneously permit clearance of the movement of the movement transfer means (28) to the transmission element pair (27 or 26) of the other one of the driving gears (25 or 24) when the movement transfer means (28) is driven in said direction by the driving device (22) and vice versa.

2. Device according to claim 1, wherein:

each transmission element pair (26, 27) includes two cooperating and rotatably mounted transmission elements (33, 34), a transmission element (33) in one (26) of the transmission element pairs (26, 27) rotates said rotatable part (8) through a connecting member (37), and another transmission element (34) in the other of said transmission element pairs (26, 27) cooperates with a transfer device (38) for transferring the rotary movements of said other transmission element (34) into reciprocating motions, said transfer device (38) driving or operating in turn an elongated member (39) to move with reciprocating motions for imparting to the flushing nozzle (9) a movement about a geometric horizontal or substantially horizontal axis (R2A).

3. Device according to claim 2, wherein:

the transfer device (38) for transferring rotary movements into reciprocating motions includes a carrier (40) which is rotatable by said other transmission element (34) of said other transmission element pairs (27) and which is provided to rotate about a threaded rod (41) which is displaceable in a reciprocating manner, the carrier (40) cooperates with the threaded rod (41) by engaging or meshing with threads (42, 43) of the threaded rod (41), and the threaded rod (41) has two of said threads (42, 43) with different thread directions, said two threads (42, 43) transforming into each other through thread transitions at the end portions of the two threads (42, 43) such that the carrier (40) during rotation in one direction can engage or mesh with one of the two threads (42 or 43) and through said thread transitions pass over into engagement with the other one of the two threads (43 or 42) for imparting reciprocating motions to the threaded rod (41).

4. Device according to claim 2, wherein the transmission elements (33, 34) of the transmission element pairs (26, 27) of the driving gears (24, 25) are centered with a geometric centre line (CL) common to said transmission elements (33, 34).

5. Device according to claim 1, wherein:

each driving gear (24 and 25 respectively) is a worm gear having a worm (31 and 32 respectively) which is driven by the driving device (22) through the movement transfer means (28), and a gear wheel (33 and 34 respectively) cooperating with each worm (31 and 32 respectively) and driving said rotatable part (8) and the flushing nozzle (9) respectively, and each worm (31 and 32 respectively) is mounted on a drive shaft (35 and 36 respectively) which is non-rotatably connected therewith and on which a one-way movement transfer device (29 or 30) is provided such that the movement transfer means (28) cooperates with each worm gear through a one-way movement transfer device (29 or 30).

6. Device according to claim 1, wherein the movement transfer means (28) is an endless means.

7. Device according to claim 1, wherein the movement transfer means (28) is a gear wheel.

8. Device according to claim 1, wherein the driving device (22) is driven or operated by energy other than by the flow of flushing liquid to said rotatable part (8) and the flushing nozzle (9).

9. Device according to claim 8, wherein the driving device (22) is an electric, pneumatic or hydraulic motor.

10. Device according to claim 9, wherein the driving device (22) is a servomotor.

11. Device according to claim 9, wherein the driving device (22) has a rotation speed of 500-1000 rpm.

12. Device according to claim 1, wherein the driving device (22) drives or operates said rotatable part (8) to rotate with 0.5-1 rpm.

13. Device according to claim 1, wherein the driving device (22) and the switch device (23) are located outside the space (2) to be flushed.

14. Device according to claim 1, wherein the driving device (22) and the switch device (23) are located in a common housing (21).

15. Device according to claim 1, wherein the control device (48) controls the driving device (22) in accordance with a control program.

16. Device according to claim 15, wherein the control program is adapted to the look of the space (2) to be flushed.

17. Device according to claim 1, wherein a control valve (13) in a supply conduit (6) for supply of flushing liquid (7) to said rotatable part (8) and the flushing nozzle (9) cooperates with a control device (50) which controls the control valve (13) for controlling the amount or volume of the flow of flushing liquid through the supply conduit (6).

18. Device according to claim 17, wherein the control valve (13) is remote-controlled.

19. Device according to claim 1, wherein only one driving device (22) is provided to rotate said rotatable part (8) about the geometric rotation axis (R1A) and the flushing nozzle (9) about the other geometric rotation axis (R2A), said only one driving device (22) rotating in opposite rotary directions (R1, R2) by reversing the rotary direction of said only one driving device (22).

20. Device according to claim 1, wherein said control device (48) cooperates with the driving device (22) through a line (49) and controls the driving device (22) to rotate in both the one and the opposite rotary directions (R1 or R2).

21. Device according to claim 1, wherein said switch device (23) is configured to rotate the rotatable part (8) but not the flushing nozzle (9) in response to the driving device (22) rotating the one rotary direction (R1).

22. Device according to claim 21, wherein said switch device (23) is configured to rotate the flushing nozzle (9) but not the rotatable part (8) in response to the driving device (22) rotating in the opposite rotary direction (R2).

23. Device according to claim 1, wherein the movement transfer means (28) is a belt or a chain.

24. Device for interior flushing of spaces in tanks or containers, comprising:

at least one pipe (6, 8, 11) for the supply of flushing liquid (7) to the space (2), a rotatable part (8) of said pipe (6, 8, 11) has at least one flushing nozzle (9) for discharging jets (10) of flushing liquid;

a driving or operating device (22) to rotate said rotatable part (8) about a geometric rotation axis (R1A) and the flushing nozzle (9) about another geometric rotation axis (R2A), the driving device (22) is provided to be brought to rotate in opposite rotary directions (R1, R2) by reversing the rotary direction of the driving device (22);

a switch device (23) is provided to bring either said rotatable part (8) or the flushing nozzle (9) to rotate in dependence of the rotary direction (R1 or R2) of the driving device (22);

a control device (48) is provided to control the driving device (22) to rotate in one or the opposite rotary direction (R1 or R2), wherein the switch device (23) comprises two driving gears (24, 25) which include transmission element pairs (26, 27);

a movement transfer means (28) is provided to transmit the rotary movements of the driving device (22) to the transmission element pairs (26, 27) of the two driving gears (24, 25) through at least one one-way movement transfer device associated with at least one of the transmission element pairs (26 or 27) of the driving gears (24, 25); and the at least one one-way movement transfer device being provided to transmit the movement of the movement transfer means (28) to the associated one of the transmission element pairs (26 or 27) of one of the driving gears (24 or 25) when the movement transfer means (28) is driven in one direction by the driving device (22), the at least one one-way movement transfer device being provided to permit clearance of the movement of the movement transfer means (28) to the associated one of the transmission element pairs (26 or 27) when the movement transfer means (28) is driven in a second direction opposite the first direction by the driving device (22).

* * * * *